US010722024B2

(12) United States Patent
Mroseck et al.

(10) Patent No.: US 10,722,024 B2
(45) Date of Patent: Jul. 28, 2020

(54) METHOD AND APPARATUS FOR PRODUCING BRISTLE FIELDS FOR BRUSHES

(71) Applicant: Braun GmbH, Kronberg (DE)

(72) Inventors: Manuel Mroseck, Waldems (DE); Guglielmo Dimuccio, Bad Vilbel (DE); Hartwig Ullrich, Oberursel (DE)

(73) Assignee: BRAUN GMBH, Kronberg (DE)

( * ) Notice: Subject to any disclaimer, the term of this patent is extended or adjusted under 35 U.S.C. 154(b) by 147 days.

(21) Appl. No.: 16/129,155

(22) Filed: Sep. 12, 2018

(65) Prior Publication Data

US 2019/0082822 A1 Mar. 21, 2019

(30) Foreign Application Priority Data

Sep. 21, 2017 (EP) ..... 17192357

(51) Int. Cl.

| | |
|---|---|
| ***A46D 3/04*** | (2006.01) |
| ***A46D 1/08*** | (2006.01) |
| ***A46D 3/00*** | (2006.01) |
| ***A46D 3/08*** | (2006.01) |

(52) U.S. Cl.

CPC ..... *A46D 3/04* (2013.01); *A46D 1/08* (2013.01); *A46D 3/005* (2013.01); *A46D 3/082* (2013.01)

(58) Field of Classification Search

CPC . A46D 3/04; A46D 1/08; A46D 3/005; A46D 3/082; A46D 3/042; A46D 3/045; A46D 3/00; A46D 3/08; A46B 3/06

See application file for complete search history.

(56) References Cited

U.S. PATENT DOCUMENTS

| | | | | |
|---|---|---|---|---|
| 4,609,228 A * | 9/1986 | Bickel | A46B 3/06 264/243 |
| 5,033,797 A * | 7/1991 | Rueb | A46D 3/045 300/21 |
| 8,814,275 B2 * | 8/2014 | Rees | A46D 3/04 300/21 |
| 2012/0013169 A1 | 1/2012 | Rees | |

FOREIGN PATENT DOCUMENTS

| | | |
|---|---|---|
| DE | 3405001 | 8/1985 |
| EP | 0405204 | 1/1991 |
| EP | 2196107 | 6/2010 |

* cited by examiner

*Primary Examiner* — Robert J Scruggs
(74) *Attorney, Agent, or Firm* — Vladimir Vitenberg

(57) ABSTRACT

A method and an apparatus for producing bristle fields for brushes. The bristles are filled into a hole of a mold form by a feed line having an upstream end with an inlet valve and a downstream end with an outlet valve. The method includes steps of forming a bundle of bristles; applying a predefined gas pressure above atmospheric pressure in the feed line the inlet and outlet valves; inserting the bundle into the feed line at an insertion station between the inlet and outlet valves; and maintaining the predefined pressure between said valves; draining off a first volume of gas from the feed line via the outlet valve while feeding a second volume of gas into the feed line via the inlet valve, thereby moving the bundle of bristles in the feed line towards the mold form, wherein the pressure in the feed line upstream and downstream of the bundle of bristles is kept above atmospheric pressure.

16 Claims, 2 Drawing Sheets

METHOD AND APPARATUS FOR PRODUCING BRISTLE FIELDS FOR BRUSHES

FIELD OF THE INVENTION

The present invention is concerned with a method for producing bristle fields for brushes, wherein bristles are filled into at least one hole of a mold form by means of a feed line. The feed line may have an upstream end with an inlet valve and a downstream end with an outlet valve at the mold form. Further, the present invention is concerned with an apparatus for producing bristle fields for brushes.

BACKGROUND OF THE INVENTION

EP 2 196 107 B1 discloses a method for the manufacture of bristle fields for brushes, wherein clusters of bristles are filled into perforations of molds. In this method the bristles are fed to the mold in clusters by means of a gas stream or an air stream via individual feed lines. The gas stream or air stream is generated by means of negative pressure, wherein, during conveying thereof, the clusters of bristles are at least temporarily additionally impinged with a compressed gas, or with compressed air, acting in the conveying direction. Similar methods applying a negative pressure for generating the gas stream or air stream in a feed line for transporting bristles are known from EP 0 405 204 A1 and DE 10 2009 013 723 A1.

A common drawback of these known methods is that it is difficult to maintain the individual bristles as a cluster of bristles during the transport in the feed line. In more detail, applying a negative pressure in the feed line often results in separating the cluster of bristles into individual bristles which loose the defined orientation within the feed line such that it is not possible to insert the bristles as a cluster into perforations of molds. A known alternative avoiding this drawback comprises the additional step of fusing one end of the cluster of bristles, thereby fixing the bristles in the cluster. However, this alternative is time consuming and energy consuming such that the additional step of fusing the bristles to form a fixed cluster is undesired.

It is an object of the present disclosure to provide an improved method or apparatus for producing bristle fields for brushes, wherein bristles can be fed without fusing the bristles as a bundle or a cluster through a feed line.

SUMMARY OF THE INVENTION

In accordance with one aspect of the present disclosure a method for producing bristle fields for brushes may comprise filling bristles into at least one hole of a mold form by means of a feed line having an upstream end with an inlet valve and a downstream end with an outlet valve at the mold form, wherein filling bristles into at least one hole of a mold comprises the steps: forming at least one loose, i.e. un-fused, bundle of bristles; applying a predefined gas pressure above atmospheric pressure in the feed line between the inlet valve and the outlet valve; thereafter inserting the bundle of bristles into the feed line at an insertion station between the inlet valve and the outlet valve while maintaining at least substantially the predefined pressure between the inlet valve and the outlet valve; thereafter draining off a first volume of gas from the feed line via the outlet valve while feeding a second volume of gas into the feed line via the inlet valve, thereby moving the bundle of bristles in the feed line towards the mold form, wherein the pressure in the feed line upstream and downstream of the bundle of bristles is kept above atmospheric pressure. In other words, a gas cushion having a pressure above atmospheric pressure is provided on either side of the bundle of bristles thereby keeping the bristles together in the bundle during transport through the feed line. In contrast to known methods applying a negative pressure for transporting the bundle of bristles through the feed line the gas cushion prevents separation of the bundle into individual bristles without requiring fusing the bristles to form a fixed bundle.

An apparatus according to the present disclosure may comprise a mold form with at least one hole for receiving a bundle of bristles, a feed line, a gas supply for feeding gas at a predefined pressure above atmospheric pressure into the feed line, an insertion station provided in the feed line, at least one inlet valve connected to the gas supply and provided at an upstream end of the feed line and at least one outlet valve provided at a downstream end of the feed line. The apparatus may further comprise a control unit connected to the inlet valve and the outlet valve and programmed such that for moving the bundle of bristles in the feed line towards the mold form the outlet valve is opened for draining off a first volume of gas from the feed line and the inlet valve is opened for feeding a second volume of gas into the feed line, wherein the pressure in the feed line upstream and downstream of the bundle of bristles is kept above atmospheric pressure.

Further details and features of the invention may be obtained from the following description of embodiments in conjunction with the drawings.

DETAILED DESCRIPTION OF THE INVENTION

Figure 1:
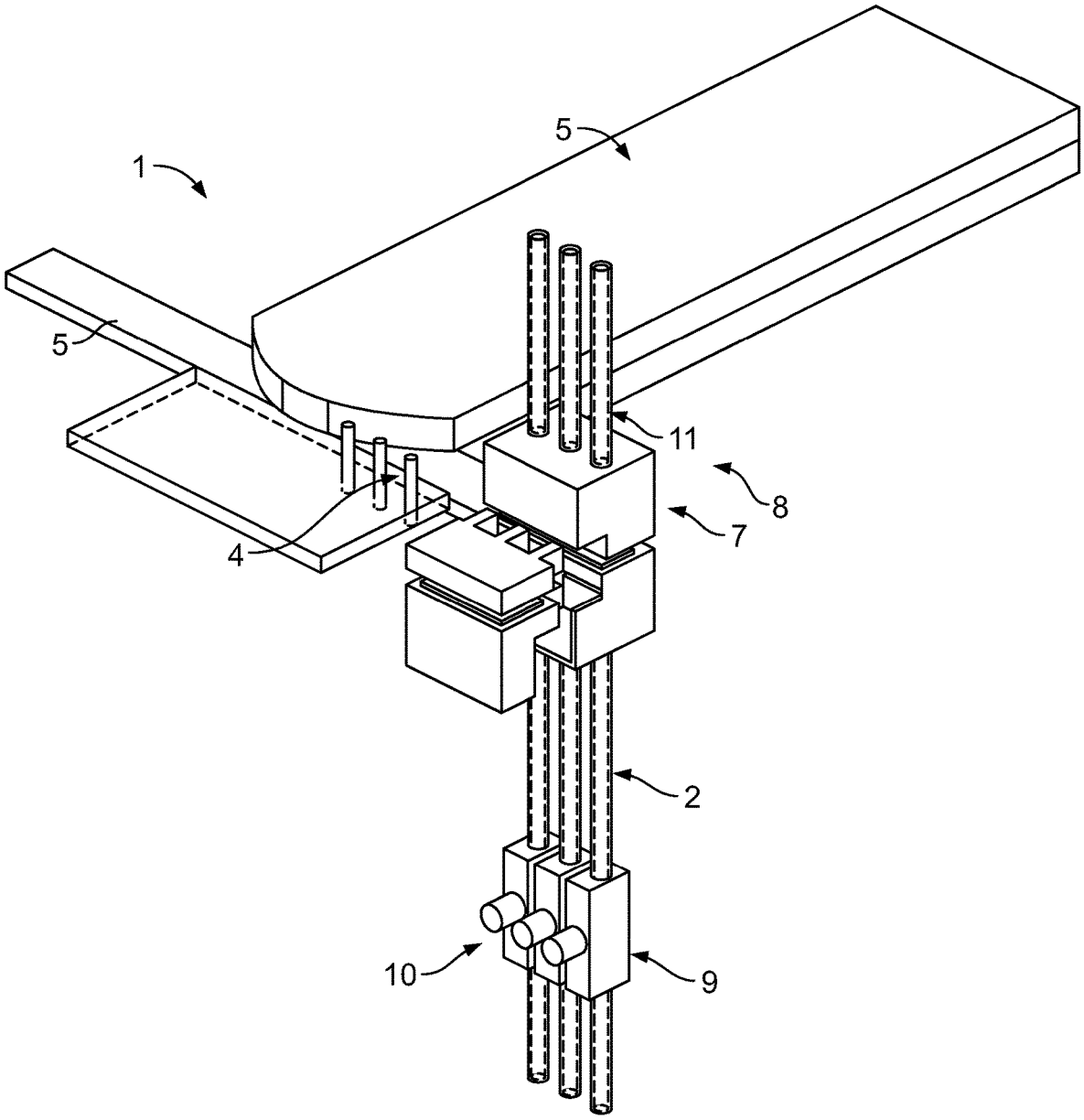
FIG. 1 shows in a schematic side view an apparatus according to a first embodiment of the invention.

According to the present disclosure, the method may comprise the step of initially forming the loose bundles or the clusters of bristles from individual bristles in that multiple bristles are separated from a supply to form the loose bundles or clusters of bristles.

In the method the movement of the bundle of bristles in the feed line towards the mold form may be effected by draining off the first volume of gas from the feed line via the outlet valve while feeding the second volume of gas into the feed line via the inlet valve, wherein the first volume is at least substantially equal to the second volume. In other words the amount of gas drained off at the downstream end of the feed line is more or less identical with the amount of gas introduced at the upstream end of the feed line, thereby maintaining an air or gas cushion with the pressure above atmospheric pressure on either side of the bundle.

For moving the bundle of bristles in the feed line towards the mold form, the outlet valve may be constantly opened for draining off the first volume of gas from the feed line. As an alternative, the outlet valve may be opened in a pulsating manner for draining off the first volume of gas from the feed line. Further, the inlet valve may be constantly opened for feeding the second volume of gas into the feed line or may be opened in a pulsating manner for feeding the second volume of gas into the feed line. For example, a control unit may be used to open and close the respective valves such that the gas cushion with the pressure above atmospheric pressure is maintained on either side of the bundle during movement of the bristles through the feed line.

The movement of the bundle of bristles may be effected by introducing and draining off gas, for example air, with the predefined gas pressure being preferably an overpressure over 5 mbar. In other words, even a very small overpressure between 5 mbar and 30 mbar may be sufficient for keeping the bristles together in a bundle during movement through the feed line. For reasons of process reliability the predefined gas pressure may be above 1000 mbar, especially between 2500 mbar and 4500 mbar, to avoid that changes in the ambient pressure may influence movement of the bristles in the feed line.

According to an aspect of the present disclosure the bundle of bristles may be stopped at the downstream end of the feed line by a baffle plate. The baffle plate may be provided downstream of the hole in the mold form such that the bundle of bristles is stopped when introduced into the hole in the mold form. Alternatively, the baffle plate may be provided upstream of the hole in the mold form requiring transport of the bundle from the baffle plate into the hole of the mold form. The provision of the baffle plate has the benefit of axially aligning the bristles in the bundle at the downstream end of the feed line.

After reaching the downstream end of the feed line, the bundle of bristles may be drawn back towards the inlet end of the feed line by draining off a volume of gas from the feed line via the inlet valve or an additional valve while feeding a volume of gas into the feed line via the outlet valve or an additional valve, wherein the pressure in the feed line upstream and downstream of the bundle of bristles is kept above atmospheric pressure, i.e. providing a gas cushion on either side of the bundle. This movement of the bundle of bristles in the opposite direction may improve axial alignment of the bristles within the bundle. After drawing back the bundle in the feed line, a volume of gas may be drained off from the feed line via the outlet valve while feeding a volume of gas into the feed line via the inlet valve, thereby moving the bundle of bristles in the feed line towards the mold form, wherein the pressure in the feed line upstream and downstream of the bundle of bristles is kept above atmospheric pressure. In other words, the bundle of bristles may be moved back and forth in the feed line based on the same principle of providing a gas cushion on the upstream side and on the downstream side of the bundle. Such a back and forth movement of the bundle within the feed line may be used in combination with a baffle plate stopping movement of the bundle in one direction for improving axial alignment of the bristles in the bundle.

In the apparatus according to the present disclosure, the insertion station may be provided in the feed line between the inlet valve and the outlet valve. In more detail, the insertion station may comprise a feeder block having at least one through-hole and which is movable relative to the feed line between a first position in which the feed line is blocked by the feeder block between the inlet valve and the outlet valve and a second position in which the through-hole forms part of the feed line between the inlet valve and the outlet valve. In other words, the bundle of bristles may be introduced into the feed line substantially perpendicular to the direction of transport in the feed line. The provision of the feeder block allows introducing the bundle of bristles without affecting the pressure, i.e. the provision of gas cushions, on either side of the insertion station in the feed line.

Preferably, the control unit connected to the insertion station. Thus, actuation of the insertion station may be effected by the same control unit which drives the valves for moving the bundle of bristles through the feed line. The insertion station may be actuated pneumatically by means of one or more valves shifting the feeder block relative to the rest of the feed line by gas pressure. In this respect the insertion station may be connected to the gas supply for feeding gas via the inlet valve into the feed line.

The feed line may comprise at least one baffle plate arranged at or near its downstream end, e.g. such that the movement of the bristles may be stopped by abutment of the baffle plate.

The apparatus according to the present disclosure may further comprise at least one throttle provided between the inlet valve and the insertion station and/or downstream of the outlet valve. In combination with the respective valve, the throttle may be used for maintaining and/or establishing the predefined pressure in the feed line or in portions of the feed line. The throttle may be a separate component part for adjusting the flow resistance of the gas being drained off from the feed line or introduced into the feed line. The throttle may be an adjustable throttle, for example connected to the control unit for selectively adjusting the flow resistance. Alternatively, at least one of the valves may be designed to have a throttle function, i.e. allowing opening the valve only partially.

In the embodiment depicted in FIG. 1 an apparatus for producing bristle fields for brushes is partially depicted. The apparatus comprises an insertion station 1 and three feed lines 2 for transporting bristles from the insertion station 1 to a not shown mold.

The insertion station 1 comprises the magazine 3 with a stock of individual bristles. The insertion station 1 comprises a mechanism for forming bundles 4 or clusters of bristles in a predefined size and for introducing said bundles into the feed lines 2. It is not required to fix the bristles into a bundle by fusing, welding or gluing. Rather, the bristles may form a loose bundle which as long as not kept together by a component of the insertion station 1 may fall apart into individual bristles.

In more detail, a feeder block 5 is provided with three through holes 6 for each receiving one bundle 4 of bristles. The feeder block 5 is movable with respect to the magazine 3 and with respect to the feed lines 2 for inserting the bundles 4 of bristles into the respective feed lines 2. In other words, the feeder block 5 is movable from the position depicted in FIG. 1 to a position in which the through holes 6 are aligned with the feed lines 2. The feed lines 2 may be closed off by the feeder block 5 as long as the through holes 6 are not aligned with the feed lines 2. As an alternative, the feeder block 5 may be provided with one or more passages permitting fluid communication between the portions of the feed lines 2 on either side of the feeder block 5.

The apparatus further comprises a block of inlet valves 7 located at or near an upstream end 8 of the feed lines 2 and a block of outlet valves 9 at or near the downstream end 10 of the feed lines 2. The in the valves 7 are connected to the gas supply 11 indicated by cubes connected to the inlet valves 7. A not shown control unit is adapted to open and close the valves 7, 9 in a controlled manner and may further serve to actuate the feeder block 5 of the insertion station 1, for example pneumatically. The valves 7, 9 may have a throttle function for selectively adjusting the flow resistance.

In the exemplary embodiment depicted in FIG. 1 the provision of three feed lines 2 permits transport of three bundles 4 of bristles either simultaneously or individually.

The number of feed lines 2 may be adapted in accordance with the requirements for of the bristle fields of the brush.

While the feed lines 2 are depicted with an identical cylindrical inner contour in the embodiment of FIG. 1, individual feed lines or all feed lines 2 may have a different inner contour depending on the requirements for the bristle fields of the brush. The number of bristles in each bundle 4 of bristles is adapted to the inner contour of the feed lines such that the bundles are movable in the feed lines with a small play.

Figure 2:
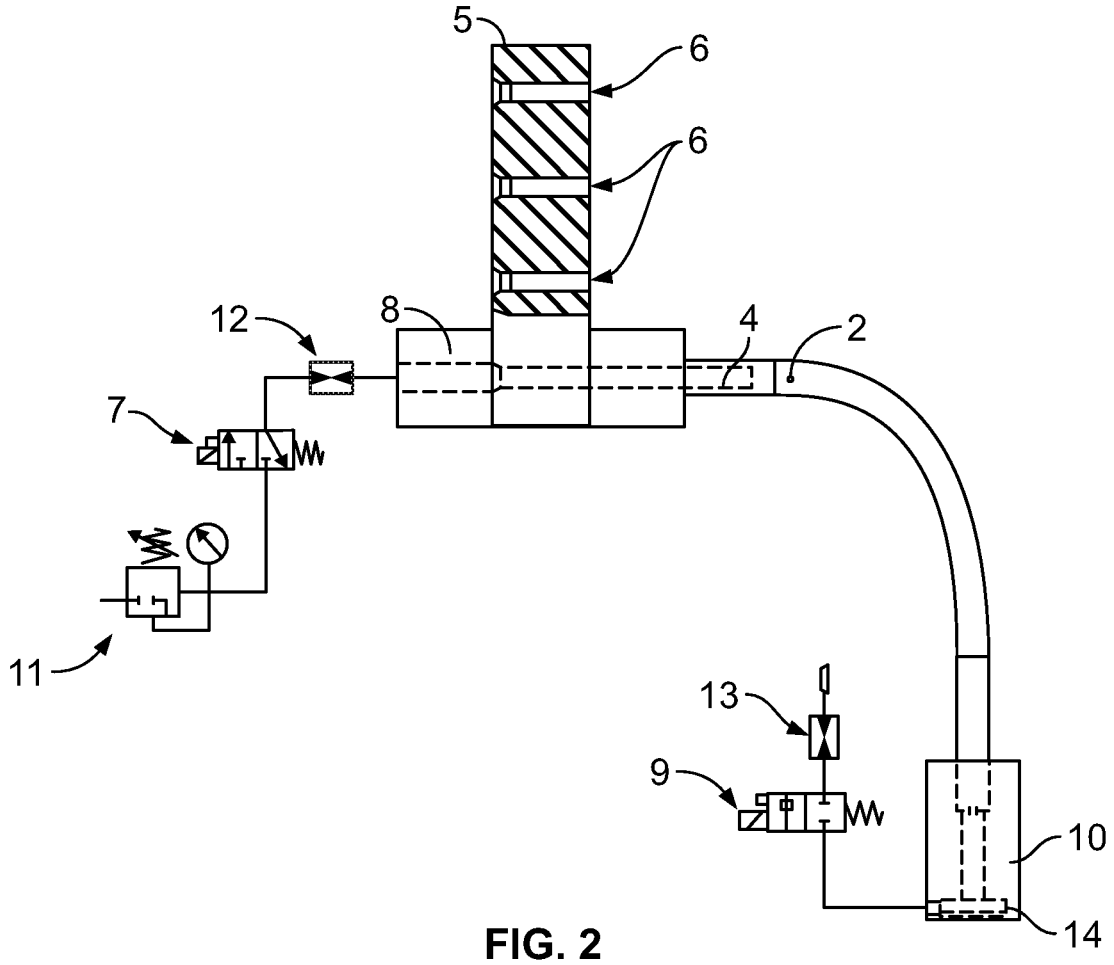
FIG. 2 shows in a schematic perspective view of an apparatus according to a second embodiment of the invention.

Referring now to the embodiment of FIG. 2, a single feed line 2 of an apparatus according to the present disclosure is depicted together with a feeder block 5 of the insertion station 1 having four through holes 6, an inlet valve 7, an outlet valve 9, a first throttle 12 located between the inlet valve 7 and the insertion station 1 and a second throttle 13 located downstream of the outlet valve 9. At or near the downstream end 10 of the feed line 2, a mold form 14 is provided having an opening (not shown) designed for receiving the bundle 4 of bristles. The outlet valve 9 is arranged such that the bundle 4 of bristles may be moved in the feed line 2 until the bundle 4 is at least partially received in the opening of the mold form 14. In the embodiment depicted in FIG. 2 this may be effected by one or more radially arranged gas ducts connecting the mold form 14 with the outlet valve 9.

A (not shown) baffle plate may be arranged in the feed line 2 or near the mold form 14 such that movement of the bundle 4 of bristles may be stopped by abutment of the bristles on the baffle plate. This may contribute in axially aligning the bristles of the bundle 4.

The apparatus of FIG. 1 or 2 may transport a bundle 4 of bristles formed in the insertion station 1 in a feed line 2 in a direction from the upstream end 8 towards the downstream end 10. For this purpose gas, for example air, is introduced into the respective feed line 2 from the gas supply 11 through the inlet valve 7, until a predefined pressure is applied in the feed line 2. The predefined pressure is above atmospheric pressure, for example a pressure between 2500 mbar and 4500 mbar. The outlet valve 9 is closed. The bundle 4 of bristles is then inserted into the respective feed line 2 by actuation of the feeder block 5 until a through hole 6 is aligned with a feed line 2. The inlet valve 7 may be closed during insertion of the bundle 4 of bristles. Thereby, the pressure in the feed line 2 is maintained at the predefined value on either side of the bundle 4 of bristles. In other words, a gas cushion with the pressure above atmospheric pressure is provided on either side of the bundle 4 of bristles at the upstream side and at the downstream side within the feed line 2.

Movement of the bundle 4 of bristles in the feed line 2 is then effected by draining off gas from the feed line via the outlet valve 9 while introducing gas into the feed line from the gas supply via the inlet valve 7. Thereby, the bundle 4 of bristles is shifted within the feed line 2 interposed between the gas cushions on the upstream side and on the downstream side.

The volume of gas drained off from the outlet valve 9 is identical, or at least substantially equal, to the volume of gas introduced through the inlet valve 7. This results in maintaining the gas cushions on either side of the bundle 4 of bristles, thereby avoiding that individual bristles are separated from the bundle 4. Draining off and introducing gas may be controlled such that the predefined pressure in the gas cushions is maintained at the upstream side and at the downstream side of the bundle 4 of bristles. The outlet valve 9 and/or of the inlet valve 7 may be opened constantly or in a pulsating manner during transport of the bundle 4 of bristles through the feed line 2. The flow resistance may be adapted by means of throttles 12, 13 and/or by the amount of opening/closing the valves 7, 9.

While it is preferred to maintain the predefined pressure at an identical or substantially identical value on either side of the bundle 4 of bristles, a small pressure gradient between the upstream side and the downstream side of the bundle 4 of bristles may be acceptable.

In some applications it may be sufficient to move a bundle 4 of bristles in one direction through the feed line 2 from the upstream end 8 towards the downstream end 10 and/or of the mold form 14. However, it is also possible to move a bundle 4 of bristles in the feed line 2 in the opposite direction, i.e. from the downstream end 10 towards the upstream end 8. This may contribute in axial alignment of the bristles within a bundle 4.

For such an opposite to movement of the bundle 4 received in the feed line 2 the outlet valve 9, the second throttle 13 or an additional valve or throttle (not shown) is connected to the gas supply or an additional gas supply for introducing a volume of gas into the feed line 2 from the downstream end 10. Simultaneously, the inlet valve 7 or an additional valve positioned at the upstream end 8 is opened constantly or in a pulsating manner for draining off gas from the upstream end 8 of the feed line 2. Again, gas cushions with a pressure above atmospheric pressure may be maintained by adjusting the volume of gas drained off from the upstream end 8 and the volume of gas introduced to the downstream end 10, thereby avoiding that individual bristles are separated from the bundle 4 during movement through the feed line 2.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application and any patent application or patent to which this application claims priority or benefit thereof, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

REFERENCE NUMERALS

1 insertion station
2 feed line
3 magazine
4 bundle of bristles

5 feeder block
6 through hole
7 inlet valve
8 upstream end
9 outlet valve
10 downstream end
11 gas supply
12 throttle
13 throttle
14 mold form

What is claimed is:

1. A method for producing bristle fields for brushes, wherein bristles are filled into at least one hole of a mold form (14) by means of a feed line (2) having an upstream end (8) with an inlet valve (7) and a downstream end (10) with an outlet valve (9) at the mold form (14), the method comprising the steps:

forming at least one bundle (4) of bristles, applying a predefined gas pressure above atmospheric pressure in the feed line (2) between the inlet valve (7) and the outlet valve (9), inserting the bundle (4) of bristles into the feed line (2) at an insertion station (1) between the inlet valve (7) and the outlet valve (9) and maintaining the predefined pressure between the inlet valve (7) and the outlet valve (9), draining off a first volume of gas from the feed line (2) via the outlet valve (9) while feeding a second volume of gas into the feed line (2) via the inlet valve (7), thereby moving the bundle (4) of bristles in the feed line (2) towards the mold form (14), wherein the pressure in the feed line (2) upstream and downstream of the bundle (4) of bristles is kept above atmospheric pressure.

2. The method of claim 1, wherein the first volume is equal to the second volume.

3. The method of claim 1, wherein the outlet valve (9) is constantly opened for draining off the first volume of gas from the feed line (2).

4. The method of claim 1, wherein the outlet valve (9) is opened in a pulsating manner for draining off the first volume of gas from the feed line (2).

5. The method of claim 1, wherein the inlet valve (7) is constantly opened for feeding the second volume of gas into the feed line (2).

6. The method of claim 1, wherein the inlet valve (7) is opened in a pulsating manner for feeding the second volume of gas into the feed line (2).

7. The method of claim 1, wherein the predefined gas pressure is an overpressure of at least 5 mbar over atmospheric pressure.

8. The method of claim 7, wherein the predefined gas pressure is between 2500 mbar and 4500 mbar.

9. The method of claim 1, wherein, after reaching the downstream end (10) of the feed line (2), the bundle (4) of bristles is drawn towards the inlet end (8) of the feed line (2) by draining off a volume of gas from the feed line (2) via the inlet valve 70 while feeding a volume of gas into the feed line (2) via the outlet valve (9), wherein the pressure in the feed line (2) upstream and downstream of the bundle (4) of bristles is kept above atmospheric pressure, and thereafter draining off a volume of gas from the feed line (2) via the outlet valve (9) while feeding a volume of gas into the feed line (2) via the inlet valve (7), thereby moving the bundle (4) of bristles in the feed line (2) towards the mold form (14), wherein the pressure in the feed line (2) upstream and downstream of the bundle (4) of bristles is kept above atmospheric pressure.

10. The method of claim 1, wherein the bundle (4) of bristles hits against a baffle plate when reaching the downstream end (10) of the feed line (2).

11. An apparatus for producing bristle fields for brushes, the apparatus comprising a mold form (14) with at least one hole for receiving a bundle (4) of bristles;

a feed line (2);

a gas supply (11) for feeding gas at a predefined pressure above atmospheric pressure into the feed line (2);

an insertion station (1) provided in the feed line (2);

at least one inlet valve (2) connected to the gas supply (11) and provided at an upstream end (8) of the feed line (2) and at least one outlet valve (9) provided at a downstream end (10) of the feed line (2);

a control unit connected to the inlet valve (7) and the outlet valve (9) and programmed such that for moving the bundle (4) of bristles in the feed line (2) towards the mold form (14) the outlet valve (9) is opened for draining off a first volume of gas from the feed line (2) and the inlet valve (7) is opened for feeding a second volume of gas into the feed line (2);

wherein the pressure in the feed line (2) upstream and downstream of the bundle (4) of bristles is kept above atmospheric pressure.

12. The apparatus of claim 11, wherein the insertion station (1) is provided in the feed line (2) between the inlet valve (7) and the outlet valve (9).

13. The apparatus of claim 11, wherein the insertion station (1) comprises a feeder block (5) having at least one through-hole (6) and which is movable relative to the feed line (2) between a first position in which the feed line (2) is blocked by the feeder block (5) between the inlet valve (7) and the outlet valve (9) and a second position in which the through-hole (6) forms part of the feed line (2) between the inlet valve (7) and the outlet valve (9).

14. The apparatus of claim 11, wherein the control unit is connected to the insertion station (1).

15. The apparatus of claim 11, wherein the feed line (2) comprises a baffle plate arranged at its downstream end (10).

16. The apparatus of claim 11, wherein at least one throttle (12, 13) is provided between the inlet valve (7) and the insertion station (1) and/or downstream of the outlet valve (9).

* * * * *